United States Patent [19]

Baldyga

[11] Patent Number: 4,598,570

[45] Date of Patent: Jul. 8, 1986

[54] APPARATUS FOR CRIMPING ELECTRIC TERMINALS

[76] Inventor: Joseph Baldyga, 107 Bayview Isle, Islamorada, Fla. 33036

[21] Appl. No.: 690,256

[22] Filed: Jan. 10, 1985

[51] Int. Cl.[4] ..... B21D 28/00

[52] U.S. Cl. ..... 72/338; 72/461; 29/753; 29/566.2; 83/228

[58] Field of Search ..... 72/338, 339, 337, 332, 72/326, 410, 409, 407, 464, 461, 427; 29/753, 748, 751, 566.2; 7/107; 83/228, 374

[56] References Cited

U.S. PATENT DOCUMENTS

| | | | |
|---|---|---|---|
| 2,951,409 | 9/1960 | Berg | 83/228 |
| 3,253,451 | 5/1966 | Kerns et al. | 72/332 |
| 3,310,973 | 3/1967 | Leis | 72/461 |
| 3,420,086 | 1/1969 | Long et al. | 29/751 |
| 3,710,610 | 1/1973 | McCaughey | 72/410 |
| 3,867,754 | 2/1975 | Koch et al. | 29/566.2 |
| 3,977,587 | 8/1976 | Baldyga et al. | 226/74 |
| 4,216,668 | 8/1980 | Walton, II | 72/410 |

FOREIGN PATENT DOCUMENTS

| | | | |
|---|---|---|---|
| 667285 | 6/1979 | U.S.S.R. | 72/332 |

*Primary Examiner*—Daniel C. Crane

*Attorney, Agent, or Firm*—Basile, Weintraub & Hanlon

[57] ABSTRACT

Apparatus for crimping electric terminals on electric conductors is disclosed which includes a locator arm operable upon initial actuation of the crimping die to accurately locate the terminal relative to the die before the terminal is engaged with the crimping elements of the die. The apparatus also includes a stripper member operable during the initial stage of retraction of the die to strip the crimped terminal from the die.

2 Claims, 12 Drawing Figures

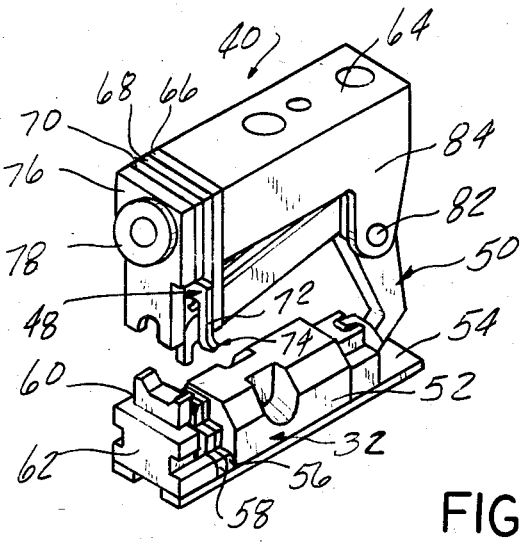
FIG - 1
FIG - 2
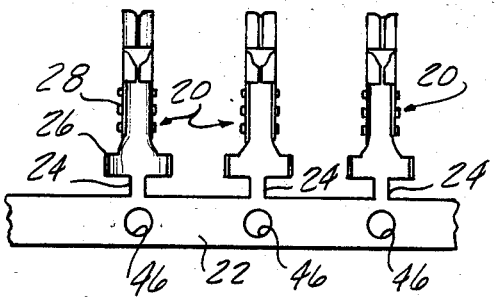
FIG - 3
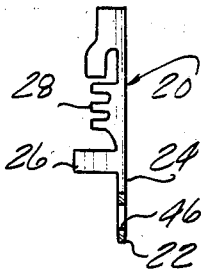
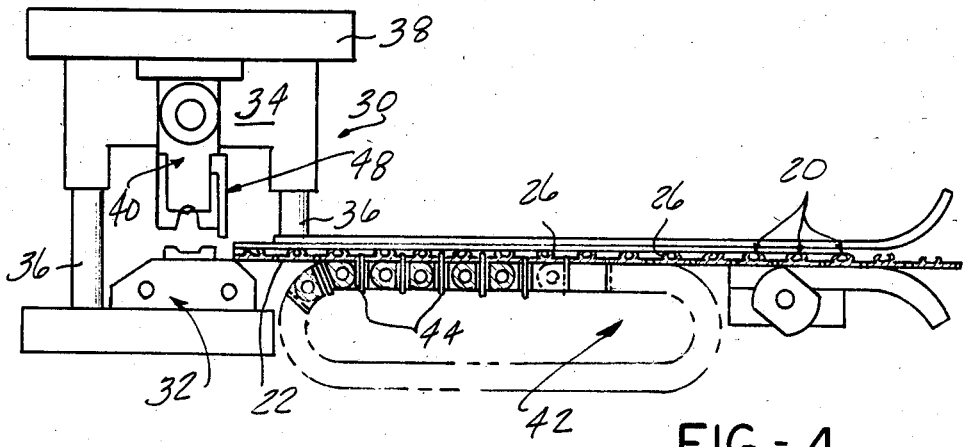
FIG - 4

APPARATUS FOR CRIMPING ELECTRIC TERMINALS

BACKGROUND OF THE INVENTION

The present invention is concerned with die apparatus employed to mechanically crimp metal electric terminals onto the end of an electric conductor.

Electric terminals with which the present invention is concerned are fixedly mounted on the end of an electric conductor to facilitate the convenient making of a secure mechanical and electrical connection of the conductor to another element of an electric circuit. While the terminals themselves are formed in a wide variety of sizes and shapes depending upon the specific application, the typical terminal, prior to attachment to the conductor, is formed with a conductor engaging portion of generally U-shaped configuration. The conductor is seated in the U-shaped portion of the terminal and the projecting legs of the U-shaped portion are then bent inwardly or crimped to surround and tightly grip the conductor.

Where relatively high volume production runs are required, the crimping operation is performed by a die assembly, and in order to achieve a reasonable production rate, it is necessary to provide a means for feeding the individual terminals to the die in an orderly manner. One such arrangement for so feeding the terminals is disclosed in U.S. Pat. No. 3,977,587. In the method disclosed in that patent, the individual terminals are integrally attached at one end to uniformly spaced locations along a carrier strip and the strip is advanced in step-by-step movement to the die by structure disclosed in U.S. Pat. No. 3,977,587. The die is provided with a cutter or severing device which will sever the terminal at the die as the terminal is being crimped onto the conductor.

The nature of the feeding device disclosed in my U.S. Pat. No. 3,977,587 is such that the feeding device is disengaged from the strip at a location spaced from the die and location of the terminal to be crimped. The location of the terminal longitudinally of the conductor on which it is to be mounted and also to the plane in which the shearing action which severs the terminal from the carrier strip is thus not firmly controlled by the feeding device. It is desired to shear the terminal from the strip at the end of the end-most U-shaped portion of the terminal and the terminal is thus connected to the strip by a relatively short neck portion extending from the end of the end-most U-shaped portion to the adjacent edge of the carrier strip. If this neck is not accurately located so that the shearing plane of the cover passes through the neck, obvious problems will arise.

Further, the typical terminal includes two longitudinally spaced U-shaped portions, one, the endmost, being conformed to be crimped around the insulation of the electric conductor and the second being conformed to be crimped around the stripped bare end of the wire. Two different die formations are required for this purpose, and alignment of the terminal with respect to the insulation and bare wire crimping dies is essential.

A second problem frequently encountered arises due to the fact that in crimping the U-shaped portion around a conductor of circular transverse cross-section, it is conventional to cause the die to progressively bend the ends of the legs of the U-shaped portions inwardly toward each other until the ends of the legs are bent inwardly from a trully circular configuration. This requires the die to have a downwardly projecting pointed central portion which, at the completion of the crimping operation is wedged between the two now reversely bent ends of the terminal legs.

As a result, difficulty is frequently encountered in disengaging the crimped terminal from the die.

The present invention is especially directed to improvements concerned with the accurate location of the terminal at the crimping station to the crimping dies and cutter mechanism and also the provision of a means for stripping the freshly crimped terminal from the die at the conclusion of the crimping operation.

SUMMARY OF THE INVENTION

Because, as noted above, electric terminals which are crimped by die apparatus of the type with which the present invention is concerned, come in a wide variety of configurations, the die assemblies are normally made in a manner such that the individual dies and anvils, each of which is matched to a specific terminal configuration, may be readily exchanged and replaced within the die assembly. In the usual case, the terminals have U-shaped crimping portions of a length of a quarter of an inch. Typically, the die and its mating anvil are formed as metal plates which, together with appropriate spacers, are simply mounted in the die assembly in face-to-face relationship with each other. The carrier strip normally is of a fixed width and is fed through a horizontal slot in a vertically movable cutter. The slot is of constant depth, extends transversely entirely across the cutter and opens at the rear surface of the cutter which is in turn in sliding face-to-face engagement with the foremost anvil of the die assembly. As the cutter moves downwardly, a shearing action on the terminal neck occurs at the stationary anvil-movable cutter interface.

The die portion of the die assembly is mounted for vertical movement above the anvil. To precisely locate the terminal at the crimping station, a vertical arm is mounted upon the die assembly offset slightly from the in-feed side (direction of movement of the carrier strip and attached terminals). The lower end of the locator arm is inclined or curved downwardly and rearwardly. As the die assembly begins its initial downward movement in a crimping operation, this inclined cam surface slidably engages the rearward edge of the carrier strip and forces the carrier strip forward to be seated firmly at the forward edge or inner end wall of the slot in the cutter. The vertical section of the locator arm which extends upwardly above this cam portion lies in a vertical general plane which is spaced rearwardly from the inner wall of the slot in the cutter by the transverse width of the carrier strip, thus the strip is firmly maintained seated against the inner end wall of the cutter slot during the cutting and crimping operation. The arm is spaced from the crimping die by a distance such that it engages the carrier strip between two adjacent terminals and the arm is elevated sufficiently to permit longitudinal advancing movement of the carrier strip when the die is in its elevated ready position.

To strip freshly crimped terminals from the die, a pivoted stripper arm is mounted on the die portion of the assembly for movement relative to the die assembly at a location adjacent to the rearward most die. Relative movement of the die assembly with respect to the stationary anvil is employed to cause the stripper to move in a downward stroke as the die starts to move upwardly from the anvil at the completion of the crimping operation. This downward movement of the arm moves the arm into engagement with the freshly crimped terminal and strips it from the upwardly moving die.

Other objects and features of the invention will become apparent by reference to the following specification and to the drawings.

IN THE DRAWINGS

FIG. 1 is a perspective view, with certain parts omitted, of a die assembly embodying the present invention;

FIG. 2 is a top plan view of a portion of a carrier strip having a typical type of electric terminal integrally attached to the strip;

FIG. 3 is a side elevational view of the strip of FIG. 2;

FIG. 4 is a front view, partially schematic, of a die assembly embodying the present invention and a feeding mechanism for feeding terminal strips of the type of FIG. 2 to the die;

Figure 5A:
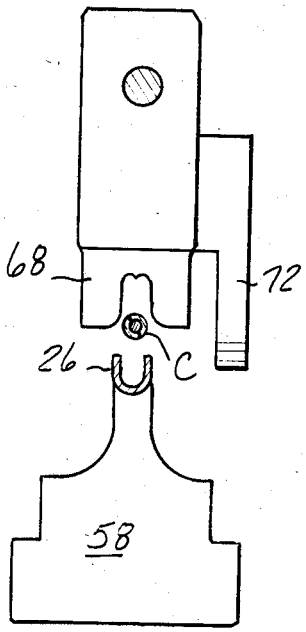
FIG. 5A is a schematic front view of a die, taken on the plane 5A—5A of FIG. 5C, locator arm and anvil showing the die in its fully opened position.

Referring first to FIGS. 2, 3 and 4, the die apparatus here disclosed operates to mechanically crimp upon the ends of electrical conductors electric terminals designated generally 20 which are supplied to the die assembly integrally attached at uniformly spaced locations to a carrier strip 22 by relatively short neck portions 24 as best seen in FIGS. 2 and 3. The individual terminals 20 may take any of several configurations, however, the terminal 20 illustrated in the drawings may be considered typical in that it includes two generally U-shaped transverse cross-section portions 26 and 28 which are conformed to be crimped respectively about the insulation and the striped, bare wire end of an electric conductor by the die apparatus, in a manner to be described in more detail below.

FIG. 4, a partially schematic front view, shows a typical die assembly arrangement. The die assembly is designated generally 30 and includes a fixedly mounted cutter and anvil assembly 32, a die housing 34 mounted for vertical reciprocation on the fixed vertical post 36 and coupled to the tool head schematically indicated at 38, of a suitable press. Various operating elements of the die itself are carried within the die housing 34 and designated generally at 40.

The press, schematically illustrated at 38, may be of any of several forms of commercially available construction, a press suitable for this purpose being disclosed and described in detail in my U.S. Pat. No. 3,791,191.

Carrier strip 22 on which the as yet uncrimped terminals 20 are mounted, is fed in step-by-step movement to die assembly 30 by a feed mechanism designated generally 42. Feed mechanism 42 in general consists of an endless conveyor having pins such as 44 which engage holes 46 (FIG. 2) in the carrier strip to advance the strip to the die in step-by-step movement. The feed mechanism 42 illustrated in the drawings is disclosed and described in detail in my U.S. Pat. No. 3,977,587, to which reference may be had for further details.

Referring now to FIG. 1, the basic operating elements of die assembly 30, with various housings and mounting plates removed, are shown. With the exception of a locator arm designated generally 48 and a stripper mechanism designated generally 50, the die construction shown in FIG. 1 is generally conventional. The anvil portion 32 includes a main spacer or locator 54 fixedly mounted upon a mounting plate. At the front end of a spacer 52, two anvils 56 and 58 are fixedly, but detachably, located. The individual anvils, 56 and 58, consist of flat plates of appropriate thickness cut into a shape such as that shown in FIG. 5A. At the front of anvil 58, a cutter 60 is mounted for vertical sliding movement within a retainer block 62 which is in turn fixedly mounted upon main spacer 54.

The upper or die portion 40 of the assembly includes a head designated generally 64 which is provided with suitable means, not shown, to be fixedly mounted within the die housing 34 (FIG. 4). At the forward end of the head 64, crimping dies 66, 68 are located to be in respective vertical alignment with the anvils 56 and 58. Like the anvils, the individual crimping dies 66 and 68 are cut from a plate of suitable thickness in the configuration best seen in FIG. 5A. The locator arm designated generally 48 is likewise formed from a plate of appropriate thickness and includes a vertically extending arm 72 offset to one side of dies 66, 68 and having a rearwardly curved or inclined cam section 74 formed at the lower end of arm 72.

A cutter actuator 76 is mounted in front of the locator arm plate 70 in vertical alignment with cutter 60. The cutter actuator, locator arm plate 70 and crimping dies 66 and 68 are fixedly and detachably mounted upon head 64 by means of a screw passing through aligned bores in the various plates and threaded into the front of head 64, the screw having an enlarged knurled head 78 which clamps the parts firmly in position on the head 64.

Figure 8:
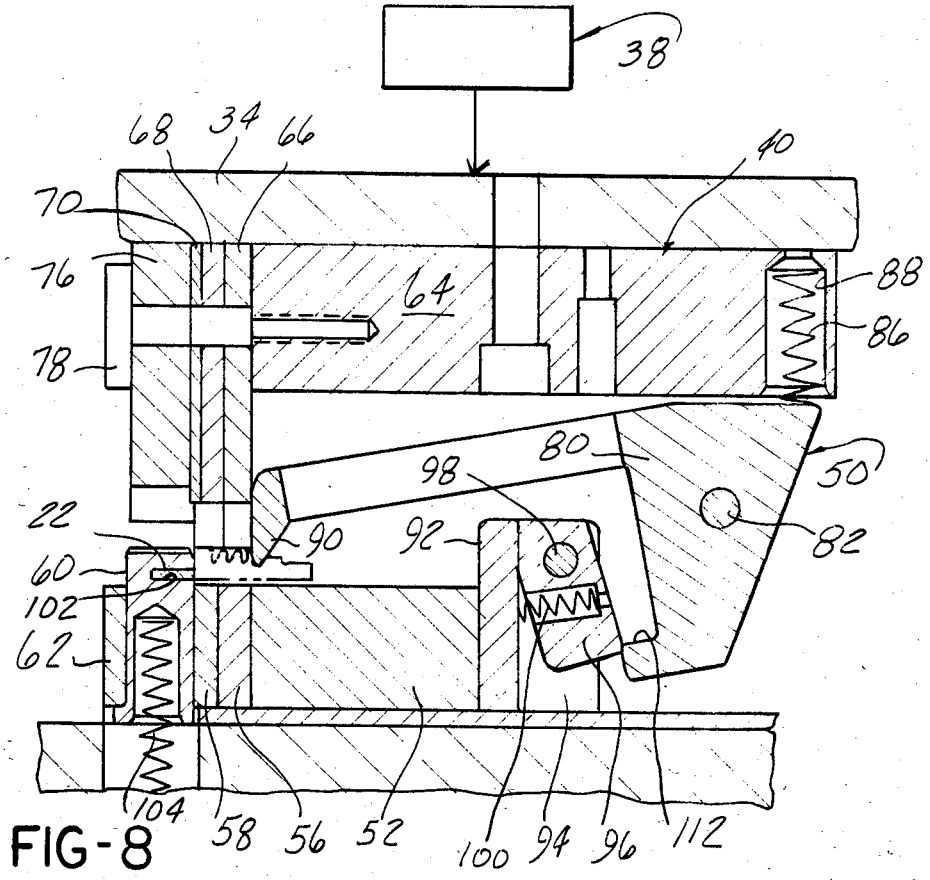
FIG. 8 is a cross-sectional view taken on a central vertical plane passing through the die assembly showing the die beginning to open after a crimping operation.
Figure 9:
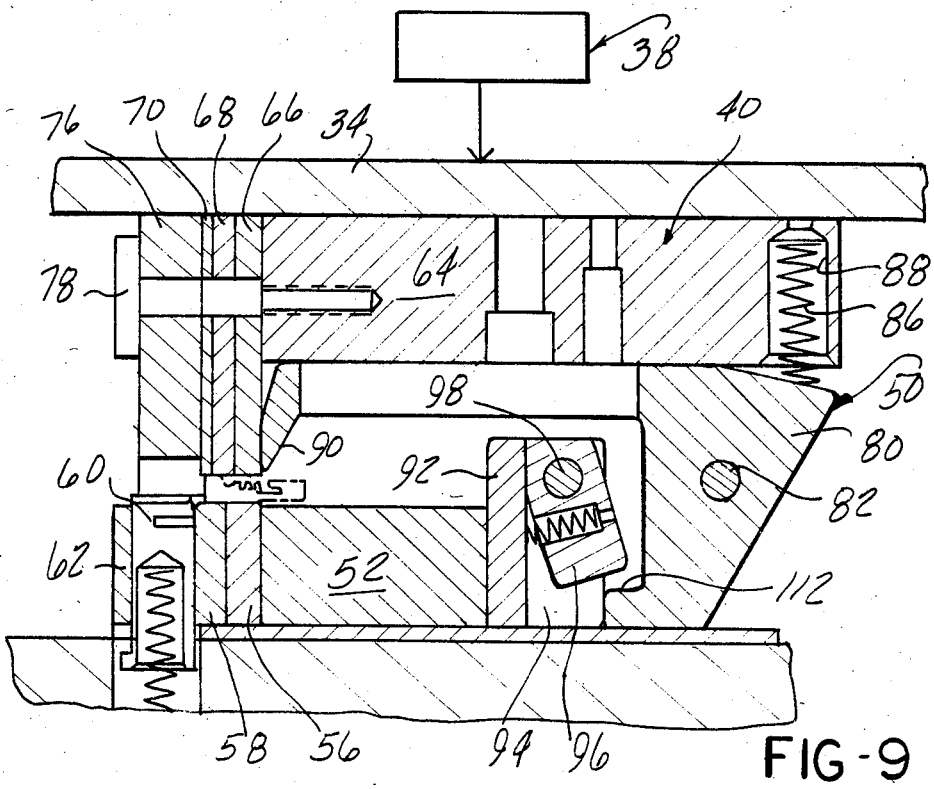
FIG. 9 is a cross-sectional view similar to FIG. 8 showing the die in its fully closed position at the completion of a crimping operation.

Details of stripper mechanism 50 are best shown in FIGS. 8 and 9.

Stripper mechanism 50 includes a stripper arm member 80 which is mounted for pivotal movement upon die head 64 such as, by a horizontal pivot pin 82 received within downwardly projecting ears 84 (FIG. 1) on head 64. A compression spring 86 seated in a bore 88 in head 64 normally biases arm 80 to the position shown in FIG. 9 in which the arm lies flat against the bottom of head 64. At the forward (left hand as viewed in FIGS. 8 and 9) end of arm 80, a downwardly projecting stripper finger 90 is formed to move up and down along the rear side of anvil 66 as the arm is pivoted about pin 82.

At the rearward end of spacer 52 of the anvil assembly, a retaining block 92 having a rearwardly opening vertical slot 94 is fixedly mounted on mounting plate 54. A cam latch member 96 is pivotally mounted within this slot by a horizontal pivot pin 98 which passes through retainer block 92 and cam latch 96. A compression spring 100 resiliently biases cam latch 96 to the position shown in FIGS. 8 and 9, but does accommodate resiliently resisted clockwise movement of the latch about pivot 98. Operation of stripper mechanism 50 will be described in connection with the overall operation of the die apparatus.

Figure 5B:
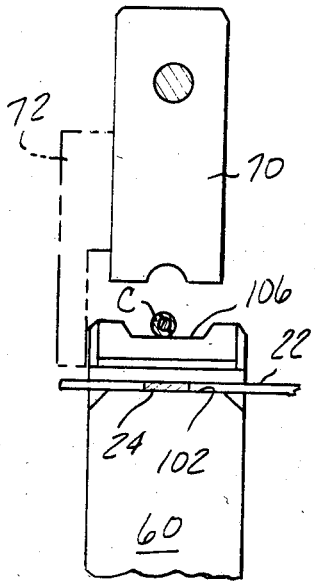
FIG. 5B is a view taken on the plane 5B—5B of FIG. 5C of the rear portions of the cutter actuator, cutter conductor and carrier strip with the parts in a position corresponding to FIG. 1.
Figure 5C:
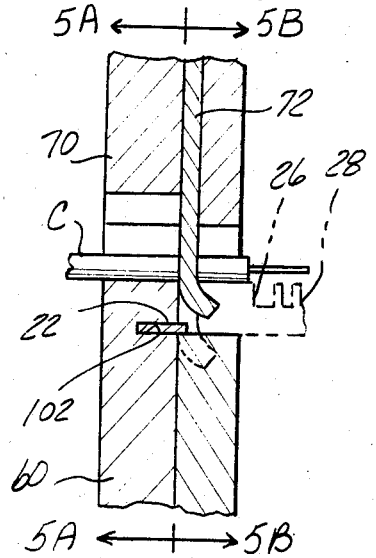
FIG. 5C is a side view, partially in section, of the cutter actuator, die, locator arm, cutter and anvil with the parts in the positions of FIGS. 5A and 5B.
Figure 6A:
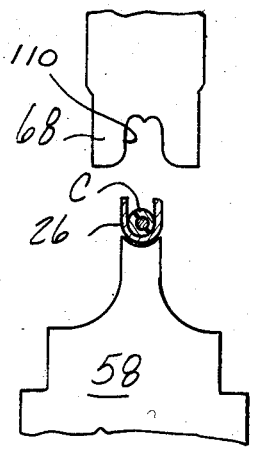
FIGS. 6A and 6B are partial detail views similar respectively to FIGS. 5A and 5B showing the parts at a later stage in the crimping operation.
Figure 6B:
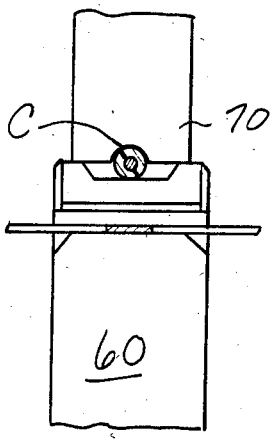
Figure 7:
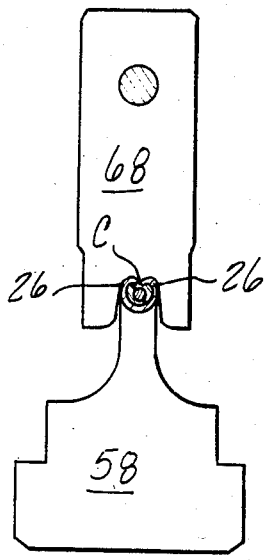
FIG. 7 is a view similar to FIG. 5A, showing the parts at the completion of the crimping operation.

The general sequence of operations, insofar as the crimping action is concerned, is best indicated in FIGS. 5–7. Initially, the upper or die portion 40 of the apparatus is located in its uppermost position. When the device is in this upper position, locator arm 48 is disposed clear above carrier strip 22 (see FIG. 4) and operation of the feed mechanism 42 is employed to advance the strip so that a terminal 20 to be crimped is positioned upon the anvils 56, 58 (see FIG. 5A) and the carrier strip itself lies within a rearwardly opening slot 102 (FIGS. 5B and 5C) formed in the cutter. At this time the cutter is located by a spring 104 (FIG. 8) so that the strip is just slightly above the upper surface of anvils 56, 58 as in FIG. 8.

With the terminal located as described above upon the anvils, the machine operator manually inserts the stripped end of a conductor to which the terminal is to be clipped into the front end of the apparatus with the conductor resting upon a locating surface 106 at the top of cutter 60. Stripper arm 80 at this time is located in the position shown in FIG. 8 and the finger at the forward end of the arm acts as a stop to locate the conductor longitudinally relative to the terminal now resting on anvils 56 and 58. The stripped bare end of the conductor will thus be located above the U-shaped portion 28 of the terminal, while the forward U-shaped portion 26 of the terminal will be longitudinally aligned with an insulated portion of the conductor.

The operator then actuates the press 38 to drive the die assembly 40 downwardly.

As the die head starts to move down, the rearwardly inclined cam surface 74 at the lower end of locator arm 72 will engage the rear edge of carrier strip 22, and as the die head continues to move downwardly, the arm slides downwardly across the rearward edge of carrier strip 22 and forces the strip forwardly as viewed in FIG. 5C to firmly seat the strip against the inner wall of slot 102 in cutter 60. This seating action occurs before either of the crimping dies engage the terminal and before the cutter actuator 76 engages the cutter.

As downward movement of the die head continues, the crimping recess 110 of a crimping die begins to engage the upper ends of the legs of a U-shaped portion such as 26. See FIG. 6A. At the same time, cutter actuator 76 has moved downwardly with the die head into engagement with the top of cutter 60 to start to drive the cutter downwardly against the biasing action of spring 104 (FIGS. 8 and 9). As can best seen in FIG. 9, eventually the cutter moves downwardly to a position such that the slot 102 of the cutter is carried below the terminal supporting surface of the front anvil 58, and this action shears the carrier strip 22 from the terminal 20 which at this time is being engaged by the crimping dies 66, 68.

The die recesses 110 are conformed to the specific terminal portions which they are to crimp, but generally consist of a smoothly curved entrance to the recess which merges into flat, slightly inwardly inclined opposed recess side edges which at their upper ends merge in turn into a reversely curved downwardly concave section. As the die moves downwardly, the outer sides of the upper ends of the U-shaped transverse cross-section portions 26, 28 are engaged between the inclined straight sections of the die recess and this edge slides relatively upwardly into the recess until it engages the concave upper end portions of the recess. As the die continues to move down, the U-shaped portions of the terminal 26, 28, are finally crimped into the configuration shown in FIG. 7. The crimping operation is now completed and the die head is returned by the press to its original upper position.

Operation of stripper mechanism 50 is best seen from FIGS. 8 and 9.

As previously stated, when the die head 64 is in its elevated or ready position, the stripper arm 80 is in the position shown in FIG. 8. As the die head moves downwardly from the FIG. 8 position, a toe 112 on arm 80 is moved downwardly below the end of cam latch 96, at which time the spring 86 biases the arm 80 in clockwise movement about pivot 82 so that the forward or left-hand end of the arm is elevated clear of the terminal as the die assembly moves to its fully lowered position as shown in FIG. 9.

As the die head begins to elevate in the return stroke from the FIG. 9 position, the toe 112 of arm 80 is carried upwardly and engages the lower surface of cam latch 96. This action, combined with further lifting movement of the die head causes the stripper arm 80 to be pivoted in a counterclockwise direction about pivot 82, thus driving the stripper finger 90 downwardly to strip the freshly crimped terminal from dies 66, 68. As further upward movement of the die head continues, further counterclockwise pivotal movement of arm 80 occurs, thus swinging toe 112 outwardly beyond the lower edge of latch 96 so that the toe eventually can pass around the corner to the position shown in FIG. 8. Spring 100 accommodates the slight necessary pivotal action of latch 96 required.

While one embodiment of the invention has been described, it will be apparent to those skilled in the art that the embodiment described may be modified. Therefore, the foregoing description is to be considered exemplary rather than limiting, and the true scope of the invention is that defined in the following claims.

I claim:

1. In an apparatus for crimping generally U-shaped transverse cross-sectional portions of an electric terminal tightly around an electric conductor, said apparatus including an anvil having a flat vertical front surface and a terminal receiving seat at the top of said anvil extending rearwardly from said front surface, crimping die means mounted above said anvil for vertical reciprocation between a ready position spaced vertically above said anvil and a lowered crimping position adjacent said anvil, said die means being operable upon downward movement to said crimping position to crimp the U-shaped portion of a terminal supported upon said terminal receiving seat, feed means for cyclically horizontally feeding along a feed path an elongate carrier strip having terminals integrally attached at one end to one side of said strip at uniformly spaced positions therealong to advance the terminals step by step in succession to said seat with said strip disposed forwardly of said front surface of said anvil, a vertically reciprocable cutter having a flat vertical rear surface in sliding face-to-face engagement with said front surface of said anvil, means defining a horizontal carrier strip receiving slot in said cutter extending transversely across said rear surface and forwardly from said rear surface to an inner wall, said cutter being vertically movable relative to said anvil between a normally maintained rest position wherein said slot is above said anvil and an actuated position wherein said slot is located below said seat on said anvil, means engageable between said die means and said cutter for driving said cutter from said rest position to said actuated position to shear a terminal on said seat from said strip upon movement of said die means from its ready position to said crimping position, and locator means comprising only a downwardly projecting arm fixedly mounted on said die means and having a downwardly and rearwardly curved lower surface located above said strip when said die means is in its ready position, said locator means being mounted on said die means in a position relative to the carrier strip feed path to that upon downward movement of said die means from said ready position to move into engagement with said carrier strip between a terminal on said seat and the next adjacent terminal and cam said strip forwardly against said inner wall of said slot prior to the shearing of said terminal from said strip.

2. The invention defined in claim 1 wherein said die means includes means defining a downwardly opening crimping recess conformed to progressively bend, during the downward stroke of said die means, the upper ends of the legs of the U-shaped portion of the terminal inwardly toward each other and downwardly into engagement with each other, and stripper means comprising a stripper member mounted for movement relative to said die means between a first position above said recess and a terminal on said seat to a second position adjacent the lower end of said recess, means biasing said stripper member to said first position, and means responsive to upward movement of said die means in its return stroke to its ready position for shifting said stripper member to said second position to engage the last crimped terminal and strip said terminal from said die means.

* * * * *